United States Patent [19]

Brauer et al.

[11] 4,182,147

[45] Jan. 8, 1980

[54] ROLLING MILLS

[75] Inventors: Hans Brauer, Leichlingen; Hartmut Diel, Monchengladbach, both of Fed. Rep. of Germany

[73] Assignee: Friedrich Kocks GmbH & Company, Dusseldorf, Fed. Rep. of Germany

[21] Appl. No.: 952,328

[22] Filed: Oct. 18, 1978

[30] Foreign Application Priority Data

Oct. 22, 1977 [DE] Fed. Rep. of Germany ..... 2747518

[51] Int. Cl.[2] ..... B21B 1/18; B21B 31/02

[52] U.S. Cl. ..... 72/224; 72/235

[58] Field of Search ..... 72/224, 234, 249, 235, 72/237, 245

[56] References Cited

U.S. PATENT DOCUMENTS 2,019,081 10/1935 Koppel ..... 72/224

2,094,920 10/1937 Inslee ..... 72/224

2,120,539 6/1938 Barth ..... 72/224

*Primary Examiner*—Milton S. Mehr

*Attorney, Agent, or Firm*—Buell, Blenko & Ziesenheim

[57] ABSTRACT

A rolling block for rolling a bar-shaped article having several rolling units mounted on a common frame, each rolling unit having three or more rollers journalled to respective pivotable elements and defining a sizing pass. For replacing the rollers, the pivotable elements can be swung about respective drive shafts from which the rollers are driven via step-up transmissions within the pivotable elements. The pivotable elements can be locked in their operative positions by hydraulically actuable coupling means and all the pivotable elements with the respective rollers therein can be fine-adjusted in the radial direction of the rollers.

19 Claims, 6 Drawing Figures

ROLLING MILLS

This invention relates to improvements in rolling mills and particularly to a rolling block for rolling a bar-shaped article, such as wire rod, and more particularly to a rolling block having a plurality of successive sizing passes each formed by at least three rollers, in which rolling block the rollers are angularly offset from sizing pass to sizing pass by half a pitch angle around the rolling axis on the longitudinal axis of the work-material and are journalled on pivotable elements which can be swung towards and away from the rollers axis about fixed pivots.

In the use of a known rolling block of this type, the bar-shaped work-material may comprise tubes which are to be reduced, substantially lower rolling speeds being used than when rolling bar steel or even wire rod. Nowadays, rolling speeds of 60 meters per second are reached particularly during the finishing-rolling of this wire rods having a diameter of, for example, 5 to 6 mm. The aforesaid known rolling block cannot cope with these high rolling speeds.

The known construction has the substantial disadvantage of uneven running at high rolling speeds. Considerable vibration occurs which is primarily caused by the couplings between the drive shafts and the roller axles. These couplings are required, since, in the known construction, the rolling block has a large number of individual roller stands which are exchanged upon a change of programe and during servicing and repairs, thus rendering it necessary to couple and uncouple the drive shafts. The vibrations originating from these couplings cause corresponding marks on the work-material, this being unacceptable particularly when rolling wire and owing to the small cross section of the wire rod and the high demands nowadays made on the surface quality, cross-sectional shape and accuracy to size.

A further disadvantage of the known construction is that the drive means for the rollers are in the form of rows of spur gear wheels which extend paralled to the rolling axis of the work-material and which distribute the drive power over the length of the rolling block from the delivery end of the rolling block, the rotary movement at the delivery end in the first instance being transmitted from a horizontal drive shaft to the following vertical drive shafts of the individual roller stands by means of sets of bevel wheels. Since the rollers at the delivery end rotate at substantially higher speeds than at the entry end owing to the elongation of the work-material, although the bevel wheels only permit a greatly limited rotational speed, the known rolling block is, for this reason also, unsuitable for the rolling of bar steel or wire at high rolling speeds. This would also apply if spur gear wheels were used in the known construction instead of the pair of bevel wheels, since the drive power for all the stands of the rolling block would have to be tramsmitted by way of these first wheels, so that only a relatively large tooth pitch would be suitable for reasons of strength. This in turn would result in large diameters of the gear wheels and high peripheral speeds, so that, in view of the admissible streasing of the teeth, the high speeds required could not be obtained.

The known construction has the further disadvantage that the pivot points of the pivotable elements are only at short radial distance from the rolling axis, so that the arcs on which the rollers, journalled on the pivotable elements, move during adjustments have a correspondingly small radius of curvature. This means that the portion of the undesirable axial displacement of the rollers (i.e. dispearement in the axial direction of the rollers) during the adjusting movement is relatively large compared with the desired radial component of movement, so that a disadvantageous change in the shape of the sizing pass occurs when increasing or decreasing the sizing pass opening by means of the adjusting device. Such a large axial movement component of the rollers during the adjusting movement may still be acceptable when rolling tubes, although, when rolling bar steel or even wire having a small cross section, such a large axial displacement of the rollers during the adjustment movement leads to unacceptable cross sectional shapes of the work-material.

Since the other known rolling blocks for the rolling of wire also reach the limits of their performance either because the load-bearing capacity of individual parts, particularly the driven gear wheels and the bearings, cannot be increased and/or smooth running cannot be improved when using couplings on the drive shafts, an object of the invention is to provide a rolling block of the type mentioned initially which has at least three rollers per sizing pass and which does not have at least all of the disadvantages mentioned above and which, owing to its special construction and the deformation properties, protecting the work-material, of its sizing passes formed by three or more rollers, is suitable for extremely high rolling speeds, particularly for the rolling of wire, and thus attains a high rolling performance.

The present invention provides a rolling block for rolling of a bar-shaped article in which each of a plurality of successive sizing passes is formed by at least three rollers in a respective rolling unit, the rollers being angularly offset from sizing pass to sizing pass by half a pitch angle around the rolling axis of the work-material and being journalled in a cantilever manner on pivotable elements of the respective rolling unit in the cross sectional planes of the sizing passes extending transversely of the rolling axis so that the roller can be swung in these cross sectional planes towards and away from the rolling axis of the work-material, and in which the rolling block has, instead of individual readily interchangeable roller stands, a support frame which extends over the entire length of the rolling block and which directly carries the pivotable elements and in or on which are journalled synchronously driven drive shafts which are equal in number to the number of rollers of a sizing pass and which are parallel to and are uniformly distributed with large radial spacing around the rolling axis of the work-material, the axes of rotation of which drive shafts are also the pivot points for the swinging movement of the pivotable elements the rollers being driven from the respective drive shafts by way of bevel wheels in the region of the pivot points and by a transmission within respective pivotable element.

A rolling block of this kind can attain significantly higher rolling speeds than conventional rolling blocks particularly if the transmissions in the pivotable elements one step-up transmissions and it is thus significantly more economical to operate, since the higher rolling speed results in a greater output. Furthermore, the rolling block in accordance with the invention has the advantage that it permits very short distance between the sizing passes and runs more smoothly even at lower rolling speeds, so that there is far less risk of marks appearing on the work-material and irregularities in the cross-sectional shape and in the cross-section dimensions.

The smoother running of the rolling block is achieved by omitting all drive couplings within the block, this in turn being rendered possible by the fact that individual roller stands are no longer used, the rollers being journalled on the pivotable elements and the latter being secured directly to the support frame or housing. A particularly significant feature of the invention is that the drive shafts or their axes of rotation are at the same time the pivot points of the pivotable elements, since it is thereby rendered possible to make the rollers freely accessible for the purpose of changing them without having to uncouple their drive. In the rolling block in accordance with the invention, the entire drive system can remain ready for operation during changing of the rollers, so that the rollers could even be driven even during the changing operation, although, of course, this is not wise. Therefore, a coupling producing undesirable vibrations is not required anywhere and, nevertheless, the rollers can be changed in a convenient manner after the drive motor has been switched off and the pivotable elements have been swung out into their positions for removial of the rollers.

A further advantage, particularly in the case wherein a step-up transmissions are used, resides in the fact that the rotary movement of the drive motor is transmitted to the individual rollers by way of drive shafts journalled in the support frame or housing, and that these drive shafts and, above all, the bevel wheels required for change of direction, rotate at a relatively low speed, since, the particularly high speed is only reached within the individual pivotable elements by the further step-up drives fitted therein. The bevel wheels are thereby not only relieved of load with respect to the speed, but also with respect to performance, since, each pair of bevel wheels only has to transmit the power for a single roller. The transmission stages arranged within the pivotable elements also need only to transit the power for a single roller, so that it is possible to manage with small tooth pitches and thus gear wheels of small diameter which can tolerate extremely high rotational speeds. These small gear wheels also render it possible for the pivotable elements to have small dimensions which in turn render possible small roller diameters and shorter distances between the rollers in the rolling direction. Small roller diameters, which are rendered possible by journalling the rollers in a cantilever or overhung fashion in the pivotable members, have the advantage of improving the efficiency of deformation and thus only a small rise in temperature of the work-material during deformation, so that higher rolling speeds can also be obtained with respect to the work-material.

Furthermore, a large radial distance between the drive shafts and the rolling axis is advantageous. Since the axes of the drive shafts are at the same time the pivot points of the pivotable elements, the radius of curvature of the arc, on which the rollers move during the adjusting operation, is also correspondingly large, so that the component of the axial movement of the rollers is rendered extremely small compared with the component of the radial movement (i.e. movement in the radial direction of the rollers). Consequently, the unavoidable axial displacement of the rollers upon radial adjustment of the rollers by correspondingly swinging the pivotable elements can be ignored, since it lies in the order of magnitude of only a few thousandths of a millimeter, especially since the radial adjusting movments under consideration also need only to be very small in a rolling block of this type. There are no disadvantageous effects upon the cross-sectional configuration and the accuracy to size of the work-material.

The number of drive shafts depends upon the number of rollers which are required for a single sizing pass. The drive for the drive shafts can be arranged at a convenient location at one end of the rolling block. The step-up transmissing within the pivotable elements can usually be obtained by means of a single transmission stage, although it is possible to provide several transmission stages.

It is advantageous if the longitudinal planes extending radially and in the rolling direction and which, when viewed in the cross section of the rolling block, extend in a star-shaped manner through the pivot points of the pivotable elements (or the axes of rotation of the drive shafts) and through the rolling axis extend adjacent to the axes of rotation of the rollers and substantially parallel thereto. The axial displacement of the rollers during the adjusting movement is thereby kept extremely small. In the case of new rollers, whose ideal diameters still accurately correspond to the dimensions of the rolling block, the longitudinal planes and the axes of rotation of the rollers even extend exactly parallel to one another.

In a preferred embodiment of the invention, the angular offset of the rollers from rolling unit to rolling unit by half a pitch angle is obtained by alternately arranging the axes of rotation of the rollers on each side of the associated longitudinal planes extending through pivot point and rolling axis. In this embodiment, the front portions of the pivotable elements can be of identical manufacture for all rolling units and can be staggered through 180 degrees from rolling unit to rolling unit only during installation.

It is advisable to construct the pivotable elements, and thus the rollers of a rolling unit, so as to be commonly and radially adjustable. This substantially simplifies the operation of the rolling block. It is thereby advantageous if the adjusting device has an adjusting disc which is concentrically rotatable in the support frame or housing about the rolling axis and is lockable in any position and which has for each pivotable element a preferably bolt-like or sleeve-like coupling party which are arranged at the smallest possible equal radial distances from the rolling axis and by means of which corresponding coupling parts of the pivotable elements and the adjusting disc are couplable to one another, whereupon the pivotable elements or their rollers are radially adjustable by a limited amount by means of a rotary movement of the adjusting disc. It will be appreciated that such coupling means are not comparable with the initially mentioned disadvantageous couplings in the region of the drive elements, since, in the present instance, the coupling means combine coupling parts which do not rotate and consequently also cannot produce any vibrations. The coupling means only connect the adjusting disc to the associated pivotable elements.

It is thereby advisable to arrange the centre points of the coupling means of pivoted elements and adjusting disc, when in a coupling state, in the region of or directly on the longitudinal planes which extend through the pivot points and the rolling axis and parallel to the axes of the rollers. A minimum axial displacement of the rollers ensues during adjustment in the case of an adjusting device constructed in this manner, since, during the concentric rotary movement of the adjusting disc, the centre points of the coupling means which are arranged uniformly about the rolling axis always maintain the same distance from the rolling axis during every adjusting movement. Owing to its very small order of magnitude, the axial displacement in the region of the pivot points can be readily compensated for.

It is generally advantageous to push the coupling part of the adjusting disc during the rolling operation into or onto the corresponding coupling part of the pivotable element by the pressure of pressure medium and only to relieve it of pressure during adjustment and not to uncouple it. Such relief then renders it possible to effect the adjusting movement, but does not release the connection between adjusting disc and pivotable elements.

In an advantageous embodiment of the invention, the pivotable elements are not only held in a radial direction by the coupling means or holding means associated therewith, but are also held in or against the rolling direction on the adjusting disc. This renders it possible to dispense with separate fastenings for the pivotable elements. The holding means for holding the pivotable elements in or against the rolling direction can be a bolt which is insertable preferable hydraulically into a reception member of the pivotable elements and which is preferably hydraulically clampable in the said reception member.

In a further development of the invention, the support housing and the adjusting discs are of approximately C-shaped configuration when viewed in the cross section of the rolling block. This configuration permits rapid and lateral removal of any work-material which has jammed on the block. The possibility of swinging out the rollers by means of the pivotable elements, whereby the jammed work-material is immediately released, is particularly advantageous.

Furthermore, it is advisable to construct at least some of the pivotable elements so that at least one rollers can be swung out of its working position by at least 15 degrees. This has the advantage that the rollers can be brought into a readily accesible position permitting the exchange of the rollers. An angle of traverse as large as this can only be dispensed with in the case of pivotable elements in which the rollers are already readily accessible when in their working positions.

The invention is further described, by way of example, in the reference to the drawings, in which.

Figure 1:
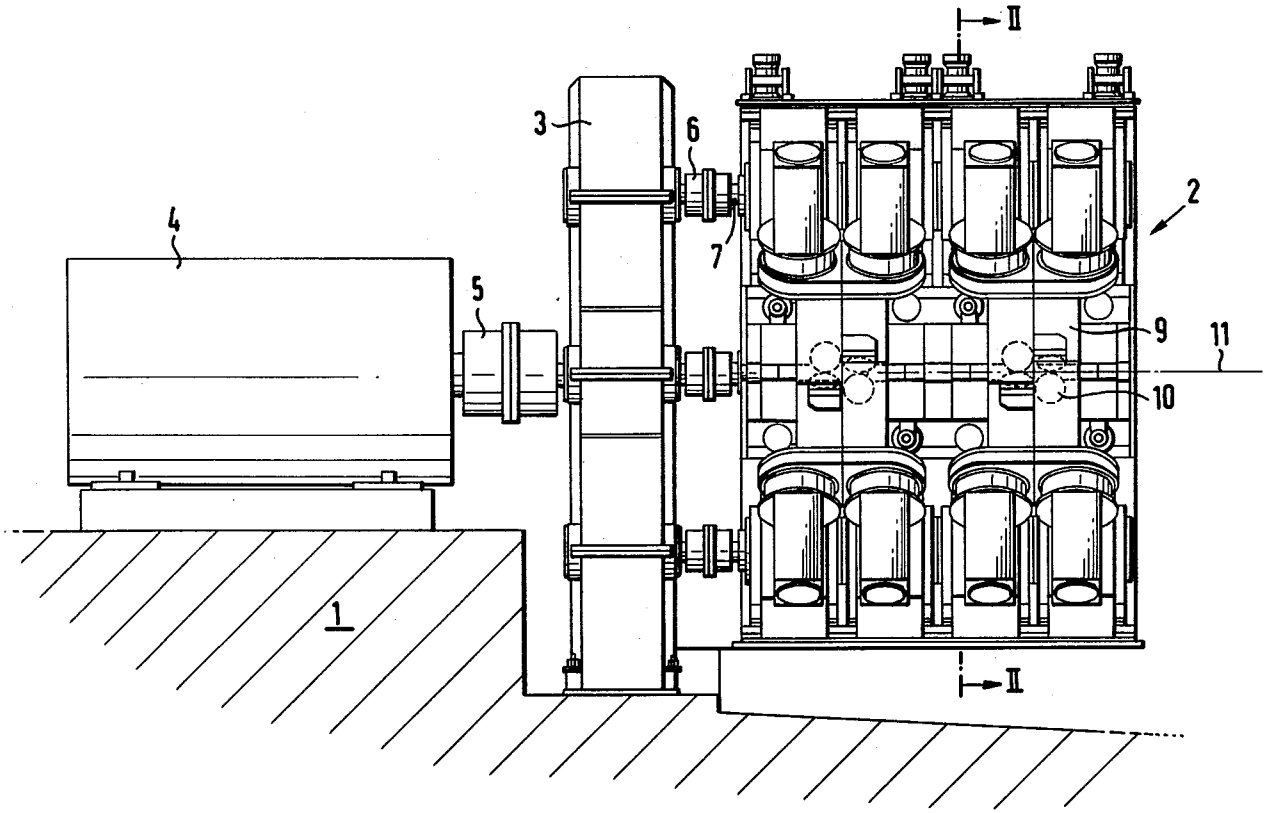
FIG. 1 is a side elevation of a rolling block with its drive.

Referring to FIG. 1, a rolling block 2 stands on a foundation 1 and is driven at one end by a motor 4 by way of a transmission unit 3. The rotary movement of the motor 4 is transmitted by way of a coupling 5 to the transmission unit 3 by which a total of three drive shafts 7 are driven synchronously by way of couplings 6. The positions of the drive shafts 7 are shown particularly in FIG. 2 which also shows that the axes 8 of rotation of the drive shafts are at the same time the pivot points of pivotable elements 9, a working roller 10 being journalled in a cantilever or overhung manner at the end of each pivotable element 9.

Each sizing pass of the illustrated rolling block 2 is defined by three rollers 10 of a respective rolling unit, so that three pivotable elements 9 are also provided on three drive shafts 7 in each rolling unit. The three drive shafts 7 are at a relatively large distance from the rolling axis 11 defined by the longitudinal axis of the work-material, the drive shafts being uniformly distributed around the rolling axis, and being directly journalled in a support housing forms a frame which extends over the entire length of the rolling block 2 and is of substantially C-shaped construction.

Figure 2:
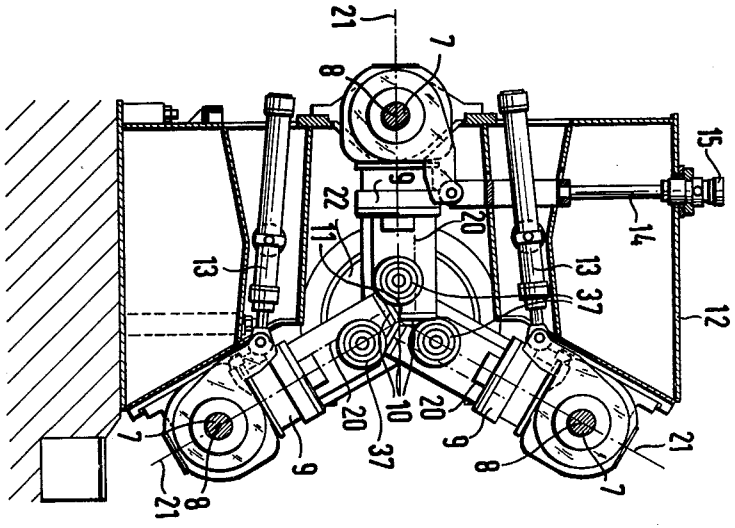
FIG. 2 is a section, taken on the line II—II of FIG. 1, showing the state of the block during the rolling operation.
Figure 3:
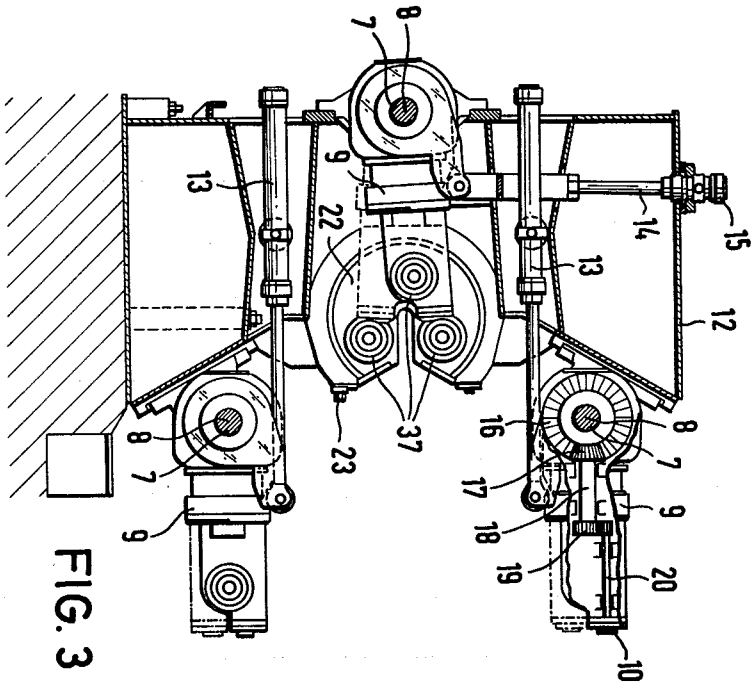
FIG. 3 is a section, taken on the line II—II of FIG. 1, showing the state of the block during exchange of the rollers.

The pivotable elements 9 and the rollers 10 are in their positions for rolling position in FIG. 2. Hydraulic cylinders 13 having a long stroke are hinged to the pivotable elements 9 and are in turn hinged in the support housing 12. This applies in FIG. 2 to the two inclined pivotable elements 9, whereas a clevis 14 having a likewise hinged hydraulic cylinder 15 is arranged on the substantially horizontally extending pivotable element 9, the hydraulic cylinder 15 having a shorter stroke than the other hydraulic cylinders 13. This shorter stroke is adequate, since a small swinging movement of the associated roller 10 is sufficient to render it possible to swing out the other two rollers 10. The other two pivotable elements 9 can be swung out through more than 15 degrees and in fact can be entirely swung out from the support frame 12, as is shown in FIG. 3. In the position shown in FIG. 3, the rollers 10 of all the pivotable elements 9 are readily accessible and can be readily exchanged, since they are journalled in an overhung manner. Furthermore, jammed material can be conveniently removed from the rolling block when the rollers are in this position. Also, the rolling block can then be thoroughly cleaned and serviced.

The upper pivotable element 9 is shown partially in section in FIG. 3 in which it can be seen that a bevel gear wheel 16 is arranged on the drive shaft 7 in the region of the rotary axis 8 thereof and is non-rotatable relative to the drive shaft 7. The bevel gear wheel drives a bevel pinion 17 and thus an intermediate shaft 18 which is rotatably journalled in the interior of the pivotable element 9 and which drives the axle 20 of the roller 10 by way of a transmission stage 19. All the transmission stages 16,17 and 18 in the pivotable element 9 step up the speed. it is quite possible to install a further transmission stage for increasing the rotational speed of the rollers. In special cases, by way of exception, a step down transmission stage may be required in the entry end rolling units.

FIG. 2 shows longitudinal planes 21 which extend radially and in the rolling direction and which extend through the pivot axes of the pivotable elements 9, i.e. the axes 8 of rotation of the drive shafts 7 and through the rolling axis 11 and extend in a star-shaped manner as viewed in the cross section of the rolling block corresponding to FIG. 2. The axles 20 of the rollers 10 extend substantially parallel to the longitudinal planes 21, and exactly parallel thereto when the rollers 10 have the correct ideal diameter, and are spaced therefrom by a distance which corresponds to half the ideal diameter of the rollers, the ideal diameter being twice the design distance between the roller axis and the rolling axis 11. This results in the arrangement of the rollers 10 which is shown in FIG. 2. Since the rollers 10 have to be angularly offset by half a pitch angle in the next-following rolling unit (not illustrated), the roller axle 20 in each of the pivotable elements 9 is arranged on the other side of the longitudinal plane 21 in the said next-following rolling unit. Such pivotable elements 9 are additionally shown by dash-dot lines in FIG. 3. In this manner, a total of only three drive shafts 7 is required despite the face that the rollers 10 are angularly offset.

Figure 4:
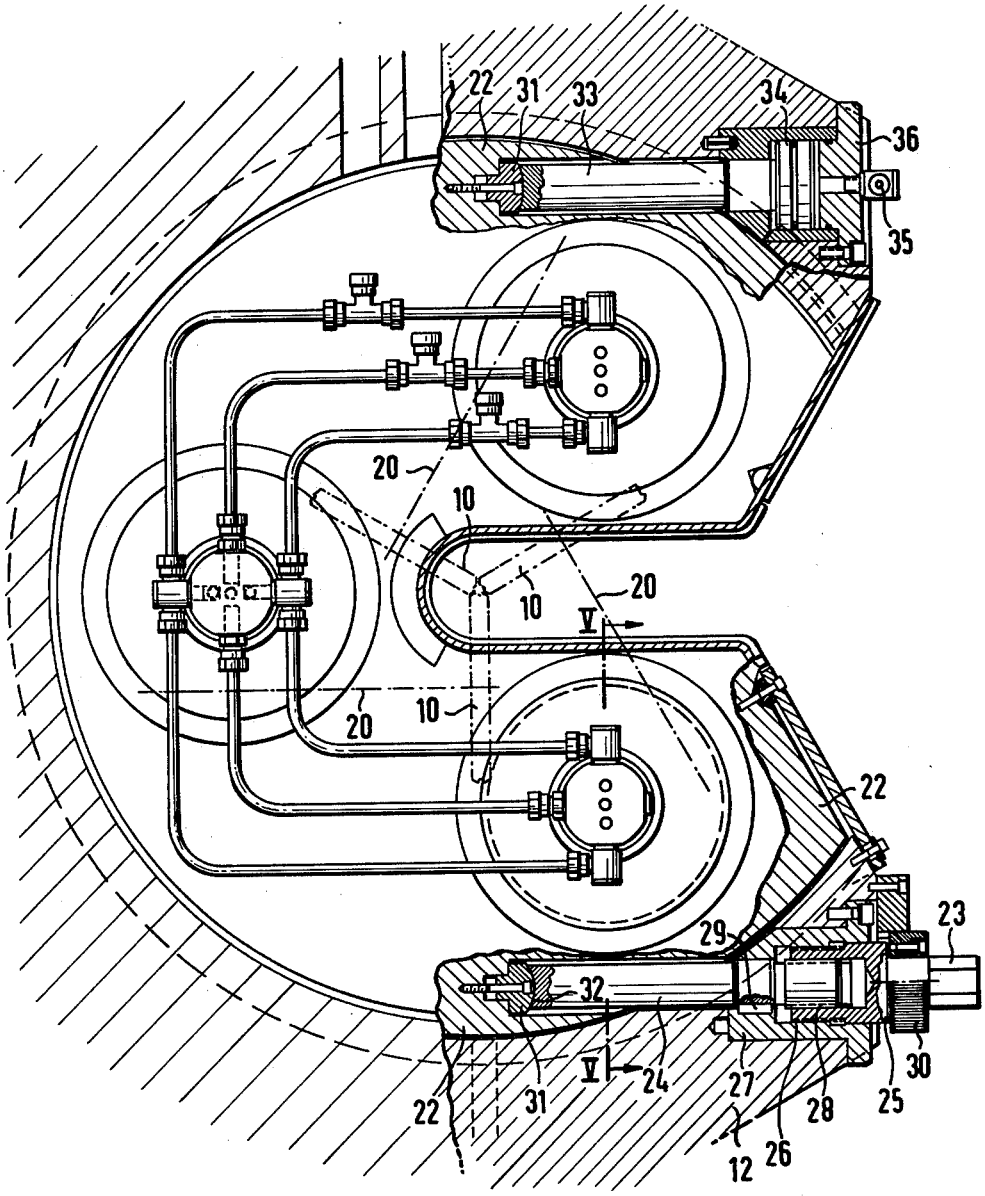
FIG. 4 is a cross-sectional view of the rolling block, showing an adjusting disc of a rolling unit, drawn to a larger scale.

Although the pivotable elements 9 are swung out of the servicing position and are swung into their working position by the working cylinders 13, the latter do not adequately lock the pivotable elements in the working position. Such locking and the fine adjustment of the rollers 10 relative to the rolling axis 11 are effected by means of a special adjusting device which is clearly shown in FIGS. 4,5 and 6. The adjusting device has a C-shaped adjusting disc 22 which is journalled so as to be concentrically rotatable about the rolling axis 11 in the support housing 12. Limited rotary movement of the adjusting disc 22 is effected manually be means of a suitable spanner applied to a hexagonal member 23, whereby a spindle 24 is displaced in an axial direction. This thrust movement must be effected very sensitively, and, for this reason, the hexagonal portion 23 is integrally formed only with a screw-threaded bush 25 whose external thread 26 can be screwed into a complementary internal thread on a fixed bearing bush 27. The external thread 26 has a different pitch from that of external thread 28 of the adjusting spindle 24 which is screwed into the adjusting bush 25. The adjusting spindle 24 is non-rotatably but axially displaceably mounted by means of a key 29, so that, when the hexagonal portion 23 is turned, the adjusting spindle is axially displaced in conformity with the difference between the pitches of the two threads 26 and 28. A graduated ring 30 facilitates accurate adjustment.

The adjusting spindle 24 acts upon a thrust member 31 which has a curved bearing surface 32, and which is fixed to the adjusting disc 22. In order to be able to adjust the adjusting disc 22 accurately and without play, a second spindle 33 is provided above the rollers 10 (indicated only by dash-dot lines in FIG. 4) and also acts upon the adjusting disc 22 by way of a thrust member 31. The end of the spindle 23 remote from the adjusting disc 22 has a piston-like head 34 on which acts pressure medium from a pressure line 35 passing through a cover 36. Pressure medium acts on the piston 34 during the rolling operation, and thus the spindle 33 is held displaced to the left as viewed in FIG. 4. This contact pressure acts against the adjusting spindle 24 and eliminated the total play between the parts 24 ao 36. The adjusting disc 22 is simultaneously locked in this manner. In order to be able to move the adjusting disc 22, the piston-like head 34 has to be relieved of the pressure of the pressure medium, and thus also the adjusting spindle 24 which can then be displaced by turning the hexagonal member 23.

As a result of the rotation of the adjusting disc 22, coupling means, generally designated 37 in FIGS. 2 and 3, swing concentrically about the rolling axis 11 together with the adjusting disc 22. The coupling means 37 couple the pivotable elements 9 to the adjusting disc 22 and the rotary movement of the adjusting disc 22 results in swinging movement of the pivotable elements 9 about the axes 8. This swinging movement is arcuate and consequently comprises radial and axial movement components relative to the rollers 10. As a result of the large distance between the longitudinal axis 11 of the work-material and the axes 8, the axial movement component is negligable compared with the radial movement component. Since the coupling means 37 are arranged on the adjusting disc 22 uniformly around the rolling axis 11 of the work-material and as short a radial distance from the rolling axis 11 as possible and since the adjusting disc 22 itself is also turned concentrically about the rolling axis 11 during adjustment, the rollers effect, in addition to this rotary movement and the desired radial movement component, only a negligible axial movement component. Since the axial movement component is only very small, it can be compensated by corresponding play in the region of the drive shafts 7 and in the region of the mounting of the pivotable elements 9 on the support housing 12 at this location. As can be seen from FIG. 2, the central axis of the part of each coupling means 37 on the pivotable element 9 lies in the longitudinal plane 21 of that pivotable element.

Figure 5:
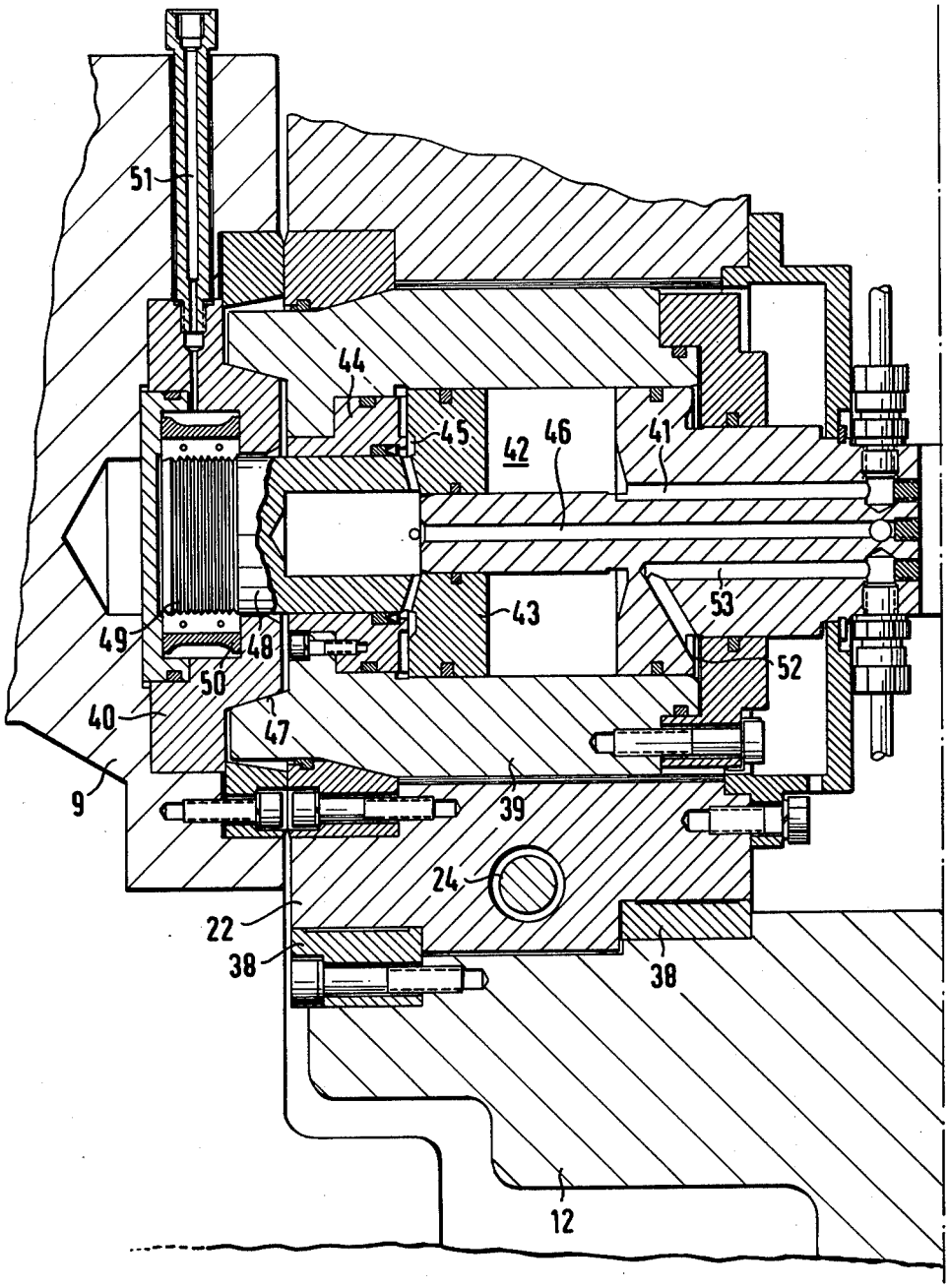
FIGS. 5 and 6 are sectional views taken on the line V—V of FIG. 4.
Figure 6:
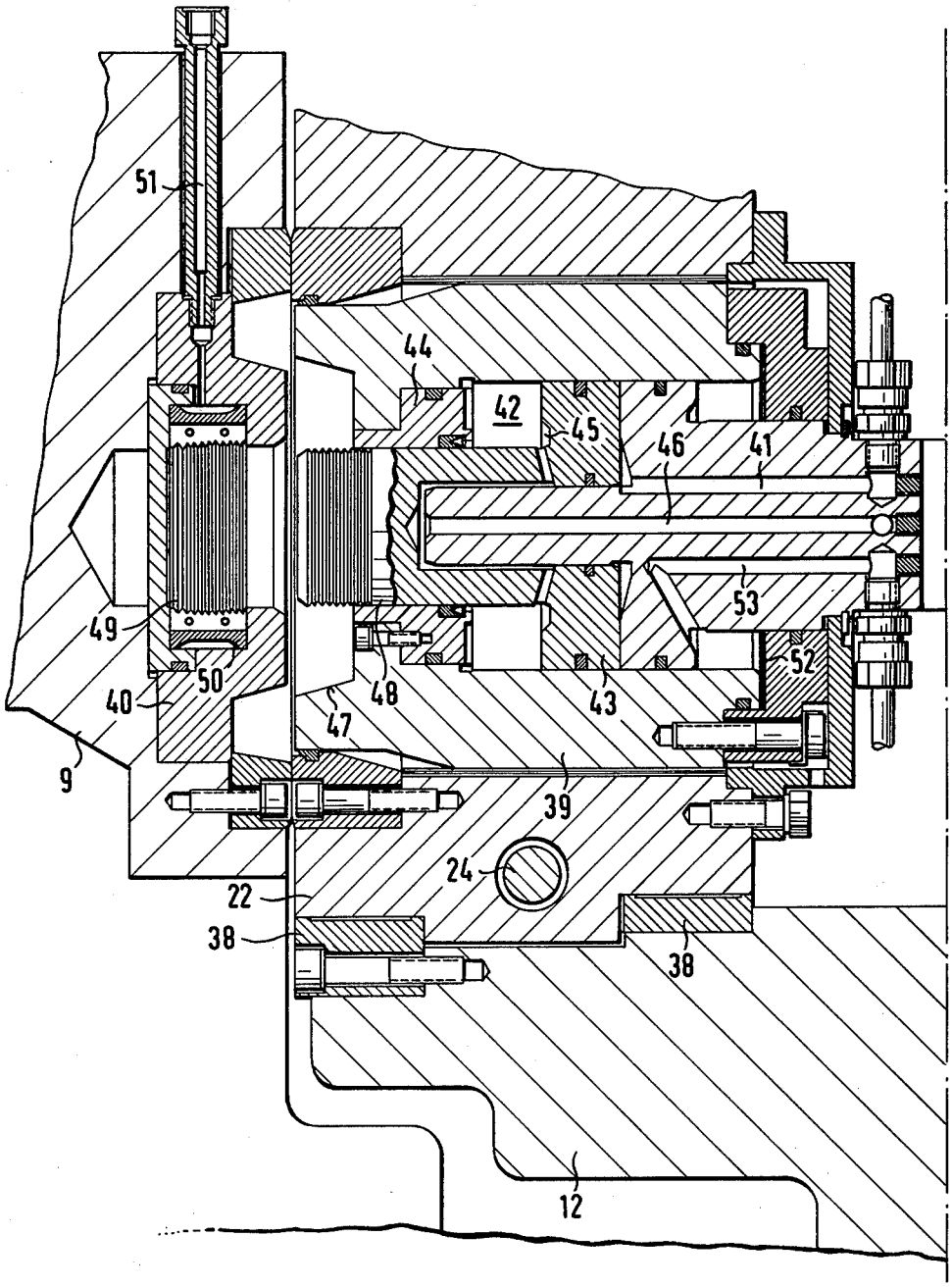

FIGS. 5 and 6 show the construction of the coupling means 37 and their actuating device. FIGS. 5 and 6 in the first instance show a portion of the support housing 12 in which the adjusting disc 22 is rotatably mounted, ring bearings 38 being provided for this purpose. In the illustrated embodiment, the part of the coupling means 37 on the adjusting disc 22 includes a coupling sleeve 39 which is so mounted in the adjusting disc 22 as to be axially displaceable by a limited amount. Referring to FIG. 5, the front rim portion of the coupling rim portion of the coupling sleeve 39 is pushed onto a projection of a coupling member 40 in the housing of the associated pivotable element 9 so as to engage therewith in a spigot-like manner. This thrust movement is effected by the pressure of pressure medium which is fed through a pressure line 41 into a annular chamber 42 in the interior of the coupling sleeve 39. A piston 43 within the coupling sleeve 39 is then displaced to the left and thereby carries along the coupling sleeve 39 by way of a sealing sleeve 44. The coupling sleeve 39 realingly slides on a pistor 54 which is fixed relative to the adjusting disc 22 and a stem 55 on the fixed piston 54 is slideble received in a blind bore in the piston 43, the annular chamber 42 being defined between the pistons 43 and 54. An annular chamber 45, disposed between the piston 43 and the sealing bush 44, is relieved by way of the interior of the piston 43 and a pressure medium line 46 in the stem 55. The pivotable element 9 and the adjusting disc 22 are thus coupled to one another by way of mating of tapers 47, such that the pivotable element 9 cannot make any swinging movement. A bolt 48 is arranged on the piston 43 and extends into the interior of the coupling member 40 of the pivotable element 9. The front end portion of the bolt 48 is provided with grooves 49 which extend into the interior of a clamping collar 50 fixedly arranged in the coupling member 40. Pressure of pressure medium can be fed to the clamping collar 50 by way of a pressure line 51, so that the clamping collar 50 tightly embraces the grooves 49 in the bolt 48, and the pivotable element 9 is also rigidly coupled to the adjusting disc 22 in an axial direction, i.e. in the direction of the rolling axis.

In order to effect the adjusting movement, it is necessary to relieve the annular chamber 42 and the clamping collar 50 from the pressure of the pressure medium, without, however, displacing the coupling sleeve 39. The rotary movement of the disc 22 necessary during adjustment, and the corresponding pivoting movement of the pivotable elements 9 can then be effected. Locking is again effected by re-admitting pressure to the annular chamber 42 and the clamping collar 50.

In order to swing out the pivotable elements as shown in FIG. 3, the annular chamber 42 and the clamping collar 50 are again relieved of pressure. Pressure medium is then admitted to the annular chamber 45 by way of the line 46, so that the bolt 48 and the piston 43 are displaced to the right. Pressure medium is also admitted by way of a line 53 to a further annular chamber 52 at the rear of the fixed piston 54, with the result that the coupling sleeve 39 moves to the right and thereby releases the pivotable element 9. This position is illustrated in FIG. 6. The pivotable element 9 can then be brought into its servicing position shown in FIG. 3. Before the next rolling operation is commenced, the pivotable elements 9 again assume the positions shown in FIG. 2 by operation of the working cylinders 13 and 15, whereupon the annular chamber 52 is relieved of pressure by way of the line 53, and pressure medium is again admitted to the annular chamber 42. The coupling sleeve 39 is displaced to the left together with the bolt 48. The required adjustment of the rollers can then be undertaken before the pivotable element 9 and the adjusting disc 22 are again rigidly coupled to one another in a play-free manner by means of the clamping collar 50.

We claim:

1. A rolled block for rolling a bar-shaped article, comprising a plurality of successive sizing passes, each pass formed by at least three rollers forming a rolling unit, said rollers being angularly offset from sizing pass to sizing pass around the rolling axis of the article, a support frame extending the full length of said rolling block, a plurality of pivotable elements at each pass corresponding in number to said at least three rollers, said pivotable elements being journalled for rotation at one end on said support frame, one of said at least three rollers being journalled in cantilever manner on the opposite end of each pivotable element, said pivotable elements being pivotable in cross sectional planes of the sizing passes extending transversely of the rolling axis of the article so that the rollers can be rotated in these cross sectional planes toward and away from the rolling axis of the article, a plurality of synchronously driven drive shafts equal in number to the number of rollers of each sizing pass, said drive shafts being parallel to and radially spaced around the rolling axis of the article, the axes of said shafts being at the pivot axis of said one end of each of said pivotable elements, gear means drivingly connecting said drive shafts and said rollers through said pivotable elements, drive means adjacent said rolling block and transmission means connecting said drive means and said drive shafts.

2. A rolling block as claimed in claim 1 in which the transmission is a step-up transmission.

3. A rolling block as claimed in claim 1 or 2 in which the axis of each roller in the rolling position is parallel to and alongside the longitudinal plane of the respective pivotable element on which said roller is mounted, which plane extends radially and in the rolling direction through both the axis of rotation of the respective drive shaft the rolling axis of the article, so that when viewed in the cross section of the rolling block, the longitudinal planes cross on the rolling axis of the article and extend radially through the pivot points of the pivotable elements.

4. A rolling block as claimed in claim 3, in which the angular offset of the rollers from rolling unit to rolling unit is obtained by alternately arranging the axes of rotation of the rollers on alternate sides of the associated longitudinal planes extending through pivot points and the rolling axis of the article.

5. A rolling block as claimed in claim 1 or 2 or 3 or 4 in which adjusting means are provided for adjusting the radial distance of the rollers from the rolling axis.

6. A rolling block as claimed in claim 5 in which the adjusting means comprises an adjusting device common to all the pivotable elements and thus the rollers of a rolling unit.

7. A rolling block as claimed in claim 6, in which the adjusting device for each rolling unit comprises an adjusting disc which is centrally rotatable in the support frame about the rolling axis of the article and is lockable in any position and which disc has for each pivotable element a first coupling element which is arranged at the smallest possible uniform radial distance from the rolling axis of the article and a corresponding second coupling part on each of the pivotable elements engaging said first coupling element whereby the pivotable elements and their rollers are radially adjustable a limited amount by means of a rotary movement of the adjusting disc.

8. A rolling block as claimed in claim 7, in which when the pivotable elements and the adjusting disc are in their engaged state, the central points of the first and second coupling parts lie in the region of or directly on the longitudinal planes which extend through the pivot points and the rolling axis of the article and parallel to the axes of the rollers.

9. A rolling block as claimed in claim 8, in which the coupling parts have mating taper surfaces.

10. A rolling block as claimed in claim 8 in which one of the coupling parts comprises an axially displaceable sleeve-like member which mates with the corresponding coupling part in a spigot-like fashion.

11. A rolling block as claimed in claim 10 in which the sleeve-like member is axially displaceable by hydraulic pressure.

12. A rolling block as claimed in claim 7 in which during the rolling operation, the first coupling parts of the adjusting disc are pushed into concentric engagement with the corresponding second coupling parts of the pivoted elements in a manner to be generally free of play by the pressure of a pressure medium and upon adjustment are only relieved of pressure but are not uncoupled.

13. A rolling block as claimed in claim 7 in which the pivotable elements are held both in a radial direction and in the rolling direction on the adjusting disc by the coupling means.

14. A rolling block as claimed in claim 19 in which the retaining means for holding the pivotable elements in or against the rolling direction comprises a bolt which is insertable into a reception member of the pivotable element and which is clamped in the said reception member.

15. A rolling block as claimed in claim 14 in which the retaining means is hydraulically actuable.

16. A rolling block as claimed in claim 7 in which each adjusting disc is of C-shaped configuration.

17. A rolling block as claimed in claim 1 in which the support frame comprises a support housing of approximately C-shaped configuration when viewed in the cross section of the rolling block.

18. A rolling block as claimed in claim 1 in which at least some of the pivotable elements can be swung out of their working positions by at least 15 degrees.

19. A rolling block as claimed in claim 7 in which the pivotable elements are held both in a radial direction and in the rolling direction on the adjusting disc by retaining means on the coupling means.

* * * * *

UNITED STATES PATENT AND TRADEMARK OFFICE

CERTIFICATE OF CORRECTION

PATENT NO. : 4,182,147

DATED : January 8, 1980

INVENTOR(S) : HANS BRAUER and HARTMUT DIEL

It is certified that error appears in the above-identified patent and that said Letters Patent are hereby corrected as shown below:

Column 6, line 48, "it" should read --It--.

Column 7, line 7, "face" should read --fact--.

Claim 7, column 10, line 17, after "element" a comma (,) should be inserted.

Signed and Sealed this

*Twenty-fifth* Day of *March 1980*

[SEAL]

*Attest:*

SIDNEY A. DIAMOND

*Attesting Officer*

*Commissioner of Patents and Trademarks*